US006527257B1

(12) United States Patent
Schuld

(10) Patent No.: US 6,527,257 B1
(45) Date of Patent: Mar. 4, 2003

(54) DECORATIVE HUMIDIFIER AND FOUNTAIN COMBINATION

(75) Inventor: Daniel E. Schuld, Palatine, IL (US)

(73) Assignee: RPS Products, Inc., Hampshire, IL (US)

( * ) Notice: Subject to any disclaimer, the term of this patent is extended or adjusted under 35 U.S.C. 154(b) by 0 days.

(21) Appl. No.: 09/943,972

(22) Filed: Aug. 31, 2001

Related U.S. Application Data

(60) Provisional application No. 60/230,030, filed on Sep. 5, 2000.

(51) Int. Cl.[7] ..... B01F 3/04

(52) U.S. Cl. ..... 261/29; 261/73; 261/106; 239/17; 239/23

(58) Field of Search ..... 261/29, 36.1, 73, 261/106, 107; 239/16, 17, 23

(56) References Cited

U.S. PATENT DOCUMENTS

| | | | | | |
|---|---|---|---|---|---|
| 907,633 | A | * | 12/1908 | Narowetz | |
| 999,114 | A | * | 7/1911 | Lang | |
| 1,173,497 | A | * | 2/1916 | Farley | |
| 3,211,378 | A | | 10/1965 | Zysk | 239/20 |
| 3,817,499 | A | * | 6/1974 | Lerou | 261/29 |
| 4,217,315 | A | | 8/1980 | Keeler, II | 261/120 |
| 4,351,652 | A | * | 9/1982 | Wisting | 261/106 |
| 4,747,538 | A | | 5/1988 | Dunn et al. | 239/20 |
| 4,836,142 | A | * | 6/1989 | Duback | 239/23 |
| 4,865,775 | A | | 9/1989 | Steiner et al. | 261/24 |
| 5,167,368 | A | | 12/1992 | Nash | 239/17 |
| 5,213,595 | A | | 5/1993 | Kim | 55/122 |
| 5,226,935 | A | | 7/1993 | Wolff et al. | 55/257.5 |
| D339,843 | S | | 9/1993 | Nash | D23/201 |
| 6,149,991 | A | * | 11/2000 | Okuda | 239/17 |
| 6,279,835 | B1 | * | 8/2001 | Hansen | 239/17 |
| 6,382,520 | B1 | * | 5/2002 | Hones | 239/17 |

* cited by examiner

*Primary Examiner*—C. Scott Bushey
(74) *Attorney, Agent, or Firm*—Greer, Burns & Crain, Ltd.

(57) ABSTRACT

A decorative humidifier and fountain apparatus containing water for simultaneously humidifying and purifying air is disclosed that produces soothing sights and sounds as well as efficiently cleaned and humidified air. It includes a housing and a water distributor for forming a water curtain from the water. The water curtain has a first portion and a second portion. An evaporative filter element is sized and proportioned to humidify and filter the air as it passes through the fountain. A pool is positioned so as to receive the water from the water curtain. Water is circulated from the pool to the water distributor with a water circulating means. An air circulator draws air through the first portion of the water curtain, forcing air through the evaporative element, then forcing air through the second portion of the water curtain.

20 Claims, 2 Drawing Sheets

DECORATIVE HUMIDIFIER AND FOUNTAIN COMBINATION

This application claims the benefit under 35 U.S.C. 120 of provisional application U.S. Ser. No. 60/230,030 filed Sep. 5, 2000 now abandoned, herein incorporated by reference.

BACKGROUND

This invention relates to a decorative humidifier and fountain. More specifically, it relates to a decorative fountain that produces large volumes of air that have been filtered and humidified.

Decorative fountains for indoor use have become a popular addition to home decor for several reasons. The sound of flowing water has a soothing effect, reducing stress, allowing the homeowner to more thoroughly relax and unwind at the end of the day. Watching water move has a similar relaxing effect, taking the watcher's mind off more mundane thoughts while focusing on droplets of water as they fall or trickle down a path to a pool.

An open pool of water also allows for evaporation, adding humidity into the air. In the winter, when furnace heating leads to very dry air, increasing the humidity by any means makes the climate more comfortable for the inhabitants and help to protect wood furniture and other household items that can become cracked or brittle if allowed to become too dry.

Water passing through air also has a cleansing effect. As droplets fall through the air, contaminants that are water soluble contact the water and are dissolved therein. Particulate matter entrained in the air, such as smoke or smog, which contacts the droplet surface, clings to the surface due to surface tension. Air that has been thoroughly contacted with water looks, feels and smells clean and fresh, like a fresh breeze after a summer rain.

Self-contained fountains are known for indoor use as well. Small table-top units provide the soothing sights and sounds of running water, but are too small to provide useful levels of humidification or air purification. Decorative water fountains are known as shown in U.S. Pat. No. 3,211,378 granted Oct. 12, 1965, and U.S. Pat. No. 5,167,368 granted Dec. 1, 1992.

Home or room humidifiers are well known for indoor use. They generally consist of a stream of air that passes through an evaporative element that is saturated with water. Although they do a fine job of humidifying the air, they are not fun to watch. There is no soothing or relaxing aspect of operating a humidifier.

Combination humidifiers and fountains are shown in a number of prior patents. U.S. Pat. No. 4,217,315 to Keeler discloses a fountain and moving helical sculpture. Water is pumped to the top of the helix floating on a pool and allowed to flow downward, causing the helix to turn due to the change in momentum of the water as it flows.

In U.S. Pat. No. 4,747,538 to Dunn et al., water is pumped to a trough, then allowed to flow downwardly over a series of solid inclined panels. The water empties into a pool below the panels. A pump constantly refills the trough with water from the pool. This apparatus relies only on room air currents and humidifies only the air that happens to come into contact with the water, thus inefficiently humidifying the air only in the vicinity of the fountain.

Kim, in U.S. Pat. No. 5,213,595, describes an indoor fountain and air cleaner. The enclosed fountain relies on a fan to draw air into the unit and expel it through vent holes. Disks of an absorbent filter media are oriented vertically below a nozzle that spouts the water upwardly. Thus, both the absorbent media and the water flow are generally parallel to the flow air. Although the fan could increase the volume of air through the unit, air and water contact is inefficient because they move generally parallel to each other, making it possible for a large volume of air to pass through the fountain without coming into direct contact with the water. Air is also permitted to bypass an absorbent filter media by taking the path of least resistance between the vertical disks of absorbent media. Complete enclosure of the fountain for silent operation also locks inside the soothing sounds of the water.

In U.S. Pat. No. 5,226,935 to Wolfe et al., a freestanding indoor humidifier includes a water curtain that empties into a collecting pool. As discussed above, the air is not channeled through the water curtain to improve contact between the air and water, thus only air immediately surrounding the device is contacted with the falling water.

None of the prior art teaches that the addition of an air circulation device, such as a fan, is useful for improving contact between the air and the water. Prior art devices are limited to treating air in the immediate vicinity of the unit that happens to come into contact with the water, thereby treating a relatively small volume of air. Once treated, the cleaner, moister air must circulate slowly due to normal air currents and diffusion, an air movement technique that is very inefficient. Although an equilibrium level of humidity would eventually be reached, humidity is lost each time a door or window is opened. The lost moisture then has to be very slowly replaced by diffusion from the fountain, leading to cleaning and humidifying of a volume of air in a room or a house that, overall, would be small or negligible.

There is a need in the art for an improved humidifier, air filter and fountain combination that contacts air and water efficiently and humidifies a volume of air. There is also a need for an improved humidifier and air filter combination that is decorative and produces soothing sights and sounds.

SUMMARY OF THE INVENTION

A decorative humidifying and fountain apparatus containing water for simultaneously humidifying and purifying air is disclosed that produces soothing sights and sounds as well as efficiently cleaned and humidified air. This combination unit performs several tasks that make indoor living more pleasant. First, the air is humidified by contact with a moving stream of water and by passing through an evaporative element. Secondly, while in contact with the water stream, impurities in that air are removed from the air. The air is also filtered through an evaporative element to remove any particulate material that may be entrained. Finally, the unit is designed as a decorative fountain or waterfall, bringing the pleasant sight and sounds of running water to the indoors.

More specifically, a decorative humidifying apparatus containing water for simultaneously humidifying and purifying air is disclosed. It includes a housing and a water distributor for forming a water curtain. The water curtain has a first portion and a second portion. A filter is sized and proportioned to filter the air as it exits the fountain. A pool is positioned so as to receive the water from the water curtain. Water is circulated from the pool to said water distributor with a water circulating means. An air circulator draws air through the first portion of the water curtain, forcing air through the filter means, then forcing air through the second portion of the water curtain.

Preferably the water flow in the water curtain and the air flow through the water curtain are transverse to each other. In the preferred embodiment, the fountain also includes a reservoir in fluid communication with the pool to supply make-up water as needed.

Compared to prior art fountains, the present invention is able to effectively treat relatively large volumes of air. The present fountain specifically directs the flow of air, rather than treating only a small volume of air that happens to contact a stream or flow of water. Air is specifically channeled to the water curtain and forced through it, rather than relying on ambient air/water contact.

Contact between the water and the air to be treated is also improved by forcing the air through the water curtain twice. Air is channeled so that it enters the unit by passing through a first or top portion of the water curtain. Here is it partially humidified and purified. The air flow is then channeled behind the water curtain and forced outward, pushing the air through the second portion of the water curtain. In passing through the water curtain a second time, there is another opportunity for the water to collect and dissolve impurities, and for water vapor to become entrained in the air flow.

In addition to forcing air flow through the water curtain, the air is also forced through an evaporative filter element. The filter is conveniently placed behind the second portion of the water curtain. In this position, it is partially hidden from view by the waterfall, making the unit more pleasant to observe. The evaporative filter element greatly improves the humidification performance of the unit. It also helps remove airborne contaminants.

DETAILED DESCRIPTION OF THE DRAWINGS

DETAILED DESCRIPTION OF THE INVENTION

Figure 1:
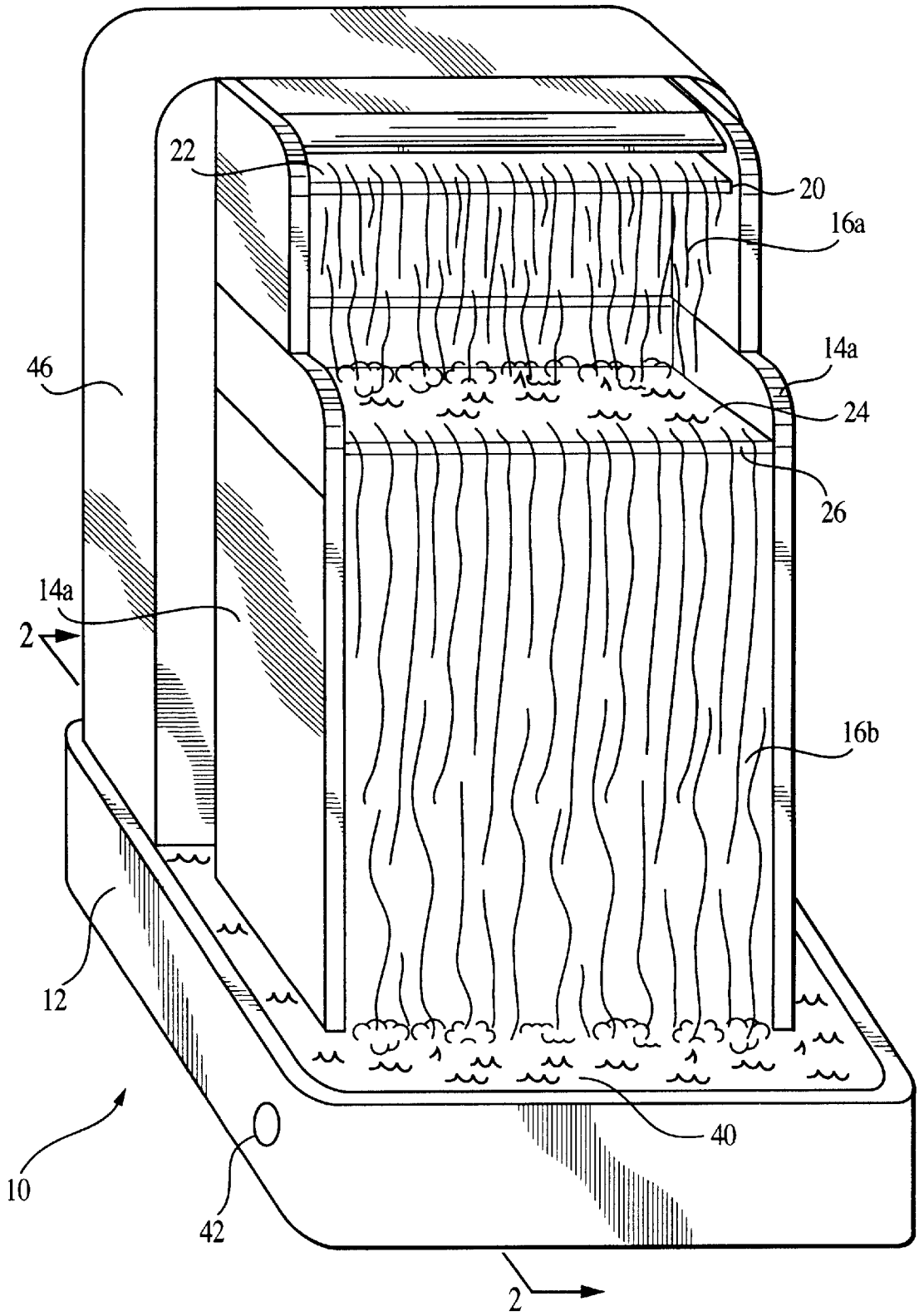
FIG. 1 shows a front perspective view of the decorative humidifier and fountain of the present invention.

The decorative humidifier and fountain unit, generally 10, includes a housing 12 that provides support for the component parts. Preferably, the housing 12 will not cover or hide the moving water. Fountains or waterfalls are interesting to watch, and the sound of trickling water is very soothing. It is, therefore, preferred that the housing 12 be minimal, allowing the sights and sounds of the moving water. The housing 12 may also include additional decorative elements, such as rocks, plants, flowers and the like. Although the housing could be adapted to be mounted to a wall or other substrate, the freestanding unit 10 shown in FIG. 1 is preferred.

The housing 12 includes at least one wall 14. Side walls 14*a* and a rear wall 14*b* may be constructed as separate units, or are optionally portions of one continuous wall. One function of the wall 14 is to help channel the air through a water curtain 16. Air that does not pass through the curtain 16 contacts the water only by chance, having less of an opportunity to be humidified. The wall 14 is suitably sized and shaped to enclose the area behind the water curtain 16, forcing the air to be drawn into the housing 12 and exit from the housing through the water curtain, thus improving contact between the air and water. Unsightly equipment and internal workings are also hidden from view by the wall 14, presenting a fountain 10 that is more visually appealing.

A water distributor 20 is used to form a water curtain 16 from the water. Any means may be used to form said water curtain 16. In its simplest form, the water distributor 20 is simply a plate 22 that allows the water to fall off an edge in a continuous curtain 16. More complex designs include an intermediate pool 24 with a weir 26 at one end over which the water flows. If an intermediate pool 24 is used, optionally it has a drain 28 to facilitate emptying of the fountain 10. In operation, drain 28 is plugged.

The water curtain 16 has at least two portions 16*a*, 16*b*. The two portions of the water curtain 16 need not be physically separated in any way, and are suitably two portions of a single, continuous water curtain. If desired, the two portions 16*a*, 16*b* are separated into physically separate streams, having an intermediate water distributor 24 between them. Separation of the water curtain 16 is generally for aesthetic purposes, and it is suitable to have any number of water curtains 16 or streams as long as a first portion 16*a* and a second portion 16*b* meet the functional requirements discussed below.

Figure 2:
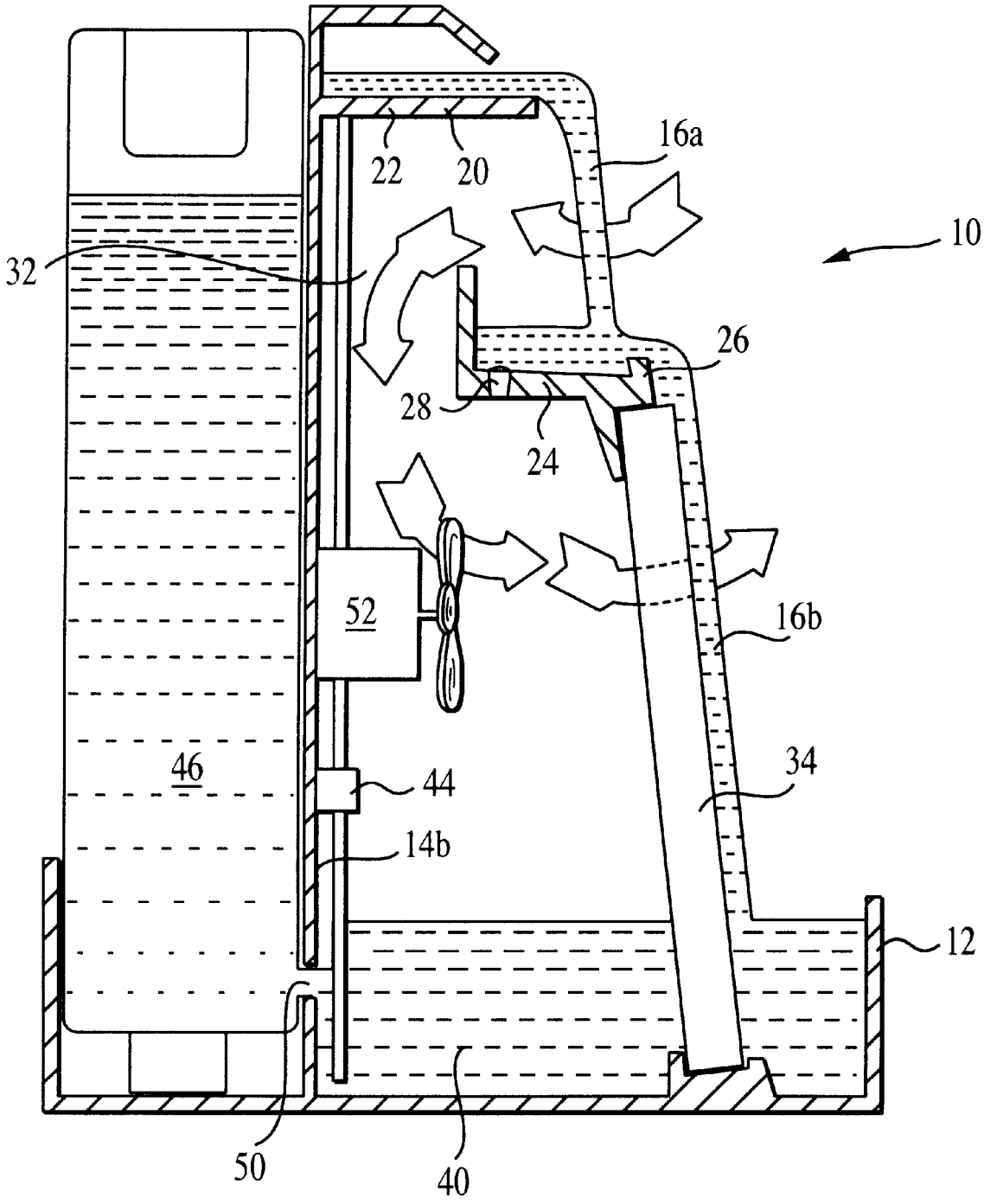
FIG. 2 shows a side cross sectional view of the decorative humidifier and fountain of the invention, taken along line 2—2 of FIG. 1.

Air is drawn from the environment into the fountain 10 through the first portion 16*a*. Water flows from the distributor 20, forming the water curtain 16 that preferably covers the entire width of the fountain 10 between the wall 14*a* on either side. The first portion 16*a* has an open space 32 between the water curtain 16 and the rear wall 14*b* to allow for circulation of air, as seen in FIG. 2. In FIG. 2, open arrows show the air flow path.

The second portion 16*b* of the water curtain 16 is characterized by the flow of air from inside the housing 12 through the water curtain 16 and into the surroundings. The second portion 16*b* is optionally located in any functional and/or aesthetically pleasing arrangement with respect to the first portion 16*b*. Although depicted in the drawings as being below the first portion 16*a*, the second portion 16*b* may be beside, in front of, on top of the first portion, or in any other arrangement as to the flow of the water.

Referring now to FIG. 2, an evaporative element or filter means 34 is placed in the path of the air flow before the air passes through the second portion 16*b* of the water curtain. This element 34 absorbs and spreads water throughout the filter. The element 34 has a multiplicity of small air passages. As the air passes through the filter element 34, it is humidified and filtered. Any evaporative element or filter 34 is suitable, the element disclosed in U.S. Pat. No. 5,374,381 granted Dec. 20, 1994 to Richard Schuld and Daniel Schuld, herein incorporated by reference, being preferred. Use of other known filter media, such as paper or slit and expanded metal is suitable.

The element 34 is located so that it is at least partially obscured when the fountain unit 10 is operating and there is water flowing down the water curtain 16. Placement of the element 34 immediately behind the water curtain 16*b* is convenient for easy access to the filter for changing or cleaning of the filter. The element 34 is placed at least partially in the path of the water curtain 16, so that the water trickles over and saturates the element. As the water flows over the filter element 34, an effect of a waterfall or rapid is obtained.

A collecting pool 40 is sized and positioned so as to receive the water from the water curtain 16. Preferably, the collecting pool 40 will be an integral portion of the housing 12. An optional drain 42 in the collecting pool 40 facilitates maintenance of the unit. Water is recycled from the collecting pool 40 to the water distributor 20 by a water circulating means 44. Preferably, the water circulating means 44 is a pump, but any method known in the art of getting the water from the collecting pool 40 to the water distributor 20 is acceptable.

As air is pulled through the upper water curtain 16*a* and pushed through the filter element 34, a portion of the water evaporates, providing the humidifying function. A reservoir 46 is provided to replenish the water lost by evaporation. Evaporation of the water causes the water level in the collecting pool 40 to drop. The reservoir 46 is in fluid communication with the collecting pool 40, and supplies make-up water as needed. A low-water adjustment mechanism 50 permits the flow of water from the reservoir 46 in response to a drop in the water level in the collecting pool 40. The low-water adjustment mechanism 50 is optionally a float operated valve, an electronic sensor, a pressure sensor, an opening that relieves a vacuum inside the reservoir 46 by admitting air when the water in the collecting pool 40 reaches a predetermined level or any device known in the art for this purpose.

Humidification and filtration of the air is enhanced by the presence of an air circulator 52, drawing air into the fountain unit 10 through the first portion of the water curtain 16*a*, pushing the air through the filter 34 and out of the fountain 10 through the second portion 16*b*. Air circulator 52 preferably comprises an electric motor and fan, but other means are optionally used to circulate the air. Addition of an air circulator 52 enhances the quantity of air that is cleaned and humidified, as well as the quality of contact between the air and the water. As the air passes through the water curtain 16, some impurities in the air removed from the air. The air circulator 52 causes the air to exit the fountain 10 through the filter element 34, then through the second portion of the water curtain 16*b*. Thus, as it exits, the air is filtered and humidified.

In the preferred embodiment, flow of the water is generally transverse to the flow of the air. Water falls from the water curtain 16 formed by the water distributor 20 to form a first portion 16*a* of the water curtain. The water is collected in an intermediate pool 24, flows over a weir 26, forming the second portion 16*b* of the water curtain 16. A filter element 34 is located between the second water curtain 16 and the housing 12. At the base of the second water curtain 16, the water collects in the collecting pool 40. The pump 44 circulates the water from the collecting pool 40 back to the water distributor 20. Low water level is sensed by the opening 50 that permits flow of water from the reservoir 46 to the collecting pool 40 by admitting air and relieving the vacuum created in the reservoir.

Air flows into the fountain unit 10 through the first portion 16*a* of the water curtain 16 by the air circulator 52, as shown in FIG. 2. The air circulates behind the intermediate pool 24, then is forced through the evaporative filter element 34. The air circulator 52 pushes the air out of the housing 12 and through the second portion 16*b* of the water curtain 16. An advantage of this design is that the water flow, as it falls down the water curtain 16, and the air flow through the water curtain, are transverse to each other. This flow pattern ensures thorough contact between the water and the air, resulting in a high degree of humidification and purification of the air. The water curtain 16 is then collected in the collecting pool 40. Water is circulated from the pool 40 back up to the water distributor 20 with the water circulator 44.

While a particular embodiment of the present decorative humidifier, air filter and fountain combination has been shown and described, it will be appreciated by those skilled in the art that changes and modifications may be made thereto without departing from the invention in its broader aspects and as set forth in the following claims.

What is claimed is:

1. A decorative humidifier and fountain apparatus containing water for simultaneously humidifying and purifying air comprising:

a housing;

a water distributor connected to said housing for forming a water curtain from the water, said water curtain having a first portion and a second portion;

a pool positioned so as to receive the water from said water curtain;

an evaporative element in said housing;

a water circulator to circulate the water from said pool to said water distributor; and an air circulator drawing air from the environment through said first portion of said water curtain, forcing air through said evaporative element, then forcing air through said second portion of said water curtain.

2. The decorative humidifier and fountain apparatus of claim 1, wherein the water flow in said water curtain and the air flow through said water curtain are transverse to each other.

3. The decorative humidifier and fountain apparatus of claim 1 further comprising a reservoir in fluid communication with said pool to supply make-up water.

4. The decorative humidifier and fountain apparatus of claim 3, further comprising a low water adjustment means.

5. The decorative humidifier and fountain apparatus of claim 1, further comprising an intermediate pool between said first portion of said water curtain and said second portion of said water curtain.

6. The decorative humidifier and fountain apparatus of claim 5 further comprising a weir over which said second portion of said water curtain falls.

7. The decorative humidifier and fountain apparatus of claim 1 wherein said housing directs air through said first portion of said water curtain.

8. The decorative humidifier and fountain apparatus of claim 1, wherein said evaporative element comprises an absorbent paper media.

9. The decorative humidifier and fountain apparatus of claim 1 wherein said housing is designed as a free-standing unit.

10. The decorative humidifier and fountain apparatus of claim 1, wherein said evaporative element is at least partially in the path of said water curtain.

11. The decorative apparatus of claim 1 wherein said evaporative element is generally transverse to the path of the air flow.

12. The decorative apparatus of claim 1 wherein said flowing water provides soothing sights and sounds in the vicinity of the apparatus.

13. A method of simultaneously humidifying and filtering air in a decorative apparatus, comprising:

forming a water curtain, said water curtain comprising a first portion and a second portion and having a top and a bottom;

drawing air from the environment through said first portion of said water curtain;

forcing the air through an evaporative element;

forcing the air through said second portion of said water curtain;

collecting the water from the bottom of said water curtain; and circulating said water collected at the bottom of said water curtain back to the top of said water curtain.

14. The method of claim 13 further comprising collecting said first portion of said water curtain in an intermediate pool.

15. The method of claim 14 further comprising forming said second portion of said water curtain using a weir on said intermediate pool.

16. The method of claim 13 further comprising automatically replenishing water lost due to evaporation from a reservoir.

17. The method of claim 16 further comprising sensing a low water level prior to said replenishing step.

18. The method of claim 13 further comprising directing air through said water curtain, using as least one wall.

19. The method of claim 13 further comprising trickling at least a portion of said water curtain down the surface of said evaporative element.

20. The method of claim 13 further comprising producing soothing sights and sounds.

* * * * *